US006412475B1

(12) United States Patent
Joos et al.

(10) Patent No.: US 6,412,475 B1
(45) Date of Patent: Jul. 2, 2002

(54) OPERATION CONTROL FOR A FUEL FEEDING MODULE WITH VARIABLE SYSTEM PRESSURE

(75) Inventors: Klaus Joos, Walheim; Jens Wolber, Gerlingen; Thomas Frenz, Noerdlingen; Markus Amler, Leonberg-Gebersheim, all of (DE); Hansjoerg Bochum, Farmington Hills, MI (US)

(73) Assignee: Robert Bosch GmbH, Stuttgart (DE)

( * ) Notice: Subject to any disclaimer, the term of this patent is extended or adjusted under 35 U.S.C. 154(b) by 12 days.

(21) Appl. No.: 09/631,017

(22) Filed: Aug. 2, 2000

(30) Foreign Application Priority Data

Aug. 2, 1999 (DE) ..... 199 36 287

(51) Int. Cl.[7] ..... F02M 37/04
(52) U.S. Cl. ..... 123/510; 123/514
(58) Field of Search ..... 123/461, 497, 123/509, 510, 511, 512, 514

(56) References Cited

U.S. PATENT DOCUMENTS

| | | | | | |
|---|---|---|---|---|---|
| 4,893,603 | A | * | 1/1990 | Siebels | 123/514 |
| 5,197,445 | A | | 3/1993 | Casari | 123/514 |
| 5,289,810 | A | * | 3/1994 | Bauer et al. | 123/510 |
| 5,623,907 | A | * | 4/1997 | Cotton et al. | 123/456 |
| 5,655,504 | A | * | 8/1997 | Iwai | 123/511 |
| 5,706,785 | A | | 1/1998 | Radermacher et al. | 123/457 |
| 5,743,239 | A | | 4/1998 | Iwase | 123/514 |
| 5,749,345 | A | * | 5/1998 | Treml | 123/456 |
| 5,762,047 | A | * | 6/1998 | Yoshioka et al. | 123/509 |
| 5,762,048 | A | | 6/1998 | Yonekawa | 123/514 |
| 5,791,317 | A | * | 8/1998 | Eck | 123/510 |
| 6,253,740 | B1 | * | 7/2001 | Rembold | 123/509 |
| 6,279,545 | B1 | | 8/2001 | Frank et al. | 123/514 |

FOREIGN PATENT DOCUMENTS

| | | |
|---|---|---|
| DE | 42 24 981 A1 | 7/1992 |
| DE | 42 24 981 A1 | 2/1994 |
| DE | 44 43 836 A1 | 6/1996 |
| DE | 197 19 607 A1 | 9/1998 |
| JP | 2-286865 | 11/1990 |

* cited by examiner

*Primary Examiner*—Tony M. Argenbright
*Assistant Examiner*—Hai Huynh
(74) *Attorney, Agent, or Firm*—Michael J. Striker

(57) ABSTRACT

A fuel supply system for supplying an internal combustion engine has a consumption-controlled fuel feeding module which at a suction side is connected with a supply tank and at the pressure side is connected with an internal combustion engine. At pressure side of the fuel feeding module a return conduit is leads to at least one pump for filling of the fuel feeding aggregate. A preliminarily supplied return is blockable by a switchable adjusting member which adjusts the return quantity with an open switchable adjusting member by means of a throttle element in all operational conditions above a minimal pump consumption.

19 Claims, 2 Drawing Sheets

OPERATION CONTROL FOR A FUEL FEEDING MODULE WITH VARIABLE SYSTEM PRESSURE

BACKGROUND OF THE INVENTION

The present invention relates to an operation-dependent advance supply of jet pumps, for example in a consumption-controlled fuel pump.

German patent document DE 42 24 981 A1 discloses a device for feeding fuel from a supply tank to an internal combustion engine of a motor vehicle. The fuel feeding device includes a supply tank at a suction side and a feeding aggregate at a pressure side connected to the internal combustion engine, as well as a branch conduit connected with the pressure side of the feeding system. It has a portion extended near the tank bottom, in which a jet pump is arranged. Its pressure pipe opens into a chamber which is separated from the tank chamber from which the feeding aggregate takes the fuel. A reliable, fast start of the internal combustion engine is guaranteed when in the branch conduit, as seen in the flow direction of the fuel, before the jet pump a check valve is arranged, which opens in response to exceeding of a predetermined limiting pressure in the branching conduit.

In mostly used embodiments, as a rule one of several jet pumps are used for cup filling of a fuel feeding aggregate or for circulating of fuel in the embodiment of a saddle tank from the pressure regulator. In the embodiment without the pressure regulator, the feeding of the jet pump or the jet pumps is performed from the advance. For this purpose in the fuel systems with the consumption-controlled fuel feeding (without a mechanical pressure regulator) in the advance mechanical overflow valves are utilized. It is open in the operation and releases a throttle cross-section which guarantees a predetermined return quantity. In the switching off case the mechanical overflow valve closes for maintaining the pressure in the fuel system.

By means of the mechanical overflow valve, the building of overpressure in fuel systems, for example in the case of thrust switching off or in the case of heat expansion of fuel is prevented, and a base load for the fuel feeding aggregate is produced, for improving this dynamic condition or in other words for shortening the response time. The return quantity can be used for supplying eventually available further jet pump. The mechanical overflow valves are formed so that the opening pressure and the throttle cross-section with the lowest fuel feeding pressure guarantees the return quantity required for the reliable operation of the jet pumps. Perjet pump the quantity is required of substantially 20 l/n.

In a consumption controlled fuel feeding aggregate, the system pressure is however variable, so that for example during cold or hot start or during hot operation the fuel quantity which flows back through the throttle increases. In particular during the start of the pressure build up starting from the opening pressure of the mechanical overflow valve, the lowest system pressure which takes place during the operation is made difficult by the flowing out fuel quantity. During turning off the pressure is held close blow the lowest system pressure, which makes difficult the pressure build up during the start by the overflow.

In the embodiment with advance supplied jet pumps, which are produced without a mechanical overflow valve but which are formed with a throttle, the pressure buildup depending on the flowing out of fuel is more difficult from the ambient pressure. During the cold start, where the effects of lower battery voltage and higher peak quantities meet with one another there is a great problem which has to be eliminated.

SUMMARY OF THE INVENTION

In accordance with the present invention a fuel supply system for supplying an internal combustion is provided, in which an advance supplied return is blockable by means of a switchable adjusting member and the return quantity is adjustable by means of a throttle element at all operational pressures above a minimal consumption.

With a switchable adjusting valve, instead of mechanical overflow valve, it is possible to completely block the return conduit during the starting phase so that the pressure build up for the high pressure part of the fuel supply system can be built by the fuel feeding aggregate without losses. In the turning off case an increased system pressure in the fuel supply system is maintained by means of the switchable adjusting member by locking the return conduit, so that during a hot start, by maintaining an increased system pressure, the vapor bubble formation in the fuel system can be suppressed.

The disadvantage of the mechanical overflow valve, that the pressure in the turning off case can be realized only close under the lowest system pressure and thereby this valve after exceeding of this pressure also opens and the pressure build up in the high pressure part is delayed, is eliminated in the inventive system.

In advantageous manner the switchable adjusting member can be connected with a control device which releases its control. The switchable adjusting member on the one hand can be formed as a blocking valve with a separate throttle part, and both components can be formed as an assembly, which is space-saving. With a fixedly predetermined throttle cross-section this can be designed with advantageous manner so that with lowest system operational pressure it guarantees a supply of the pump associated with return conduit for filling of the fuel feeding aggregate. In the embodiment with the switchable adjusting member as a cycled valve with each differently strong throttling after control, the overflow quantity can be adjusted in a desired manner and thereby can be adjusted optimally to the minimal pump consumption of such pumps, which are used for a cup filling of the fuel feeding aggregate.

In consumption-control electric fuel pumps with a variable fuel pressure a cycled valve can be used as a switchable adjusting member.

In accordance with another feature of the present invention a method or operation of the fuel supply system is provided, in which the obtained pressure build up is performed in accordance with the motor data with the control device.

By means of the inventive method for operation of a fuel supply system with the advance supplied return conduit, the blocking of the return conduit can be realized both during start and during turning off. Limiting of the overflow quantity at increased fuel pressure by reducing the throttle cross-section guarantees a reliable maximum motor consumption also at increased system pressure.

In advantageous manner the time point of opening of the return conduit by the switchable adjusting member can be activated after recognition of the start end, when the motor starts running. The start end can be defined advantageously for example by the setting of a corresponding bits. The time point of the opening of the switchable adjusting member can be advantageously realized for example by elapsing of a preselected time period, which for example is dependent on the battery voltage. The time period with which a timer is preadjusted, can be also dependent on nominal fuel pressure. In advantageous manner by means of pressure sensors in high pressure part of the fuel supply system and in fuel feeding module, the reaching of the fuel nominal pressure can be detected.

In another embodiment with the cycled valve, the overflow quantity for all operational pressure in the fuel supply system can be determined also by the minimal consumption for the pump for filling the fuel feeding aggregate.

The required ratio can be determined for example from a characteristic field in dependence on the fuel nominal pressure and the required minimal overflow quantity. The required overflow quantity can be selected constant or can be selected on a filling level in the cup of a fuel feeding aggregate, and with subdivided tank with several chambers it can be selected in dependence on the filling level in the tank chambers.

The novel features which are considered as characteristic for the present invention are set forth in particular in the appended claims. The invention itself, however, both as to its construction and its method of operation, together with additional objects and advantages thereof, will be best understood from the following description of specific embodiments when read in connection with the accompanying drawings.

BRIEF DESCRIPTION OF THE DRAWINGS

FIGS. 2.1–2.4 are inquiry branches for determination of an opening time point for the switchable adjusting member.

DESCRIPTION OF PREFERRED EMBODIMENTS

Figure 1:
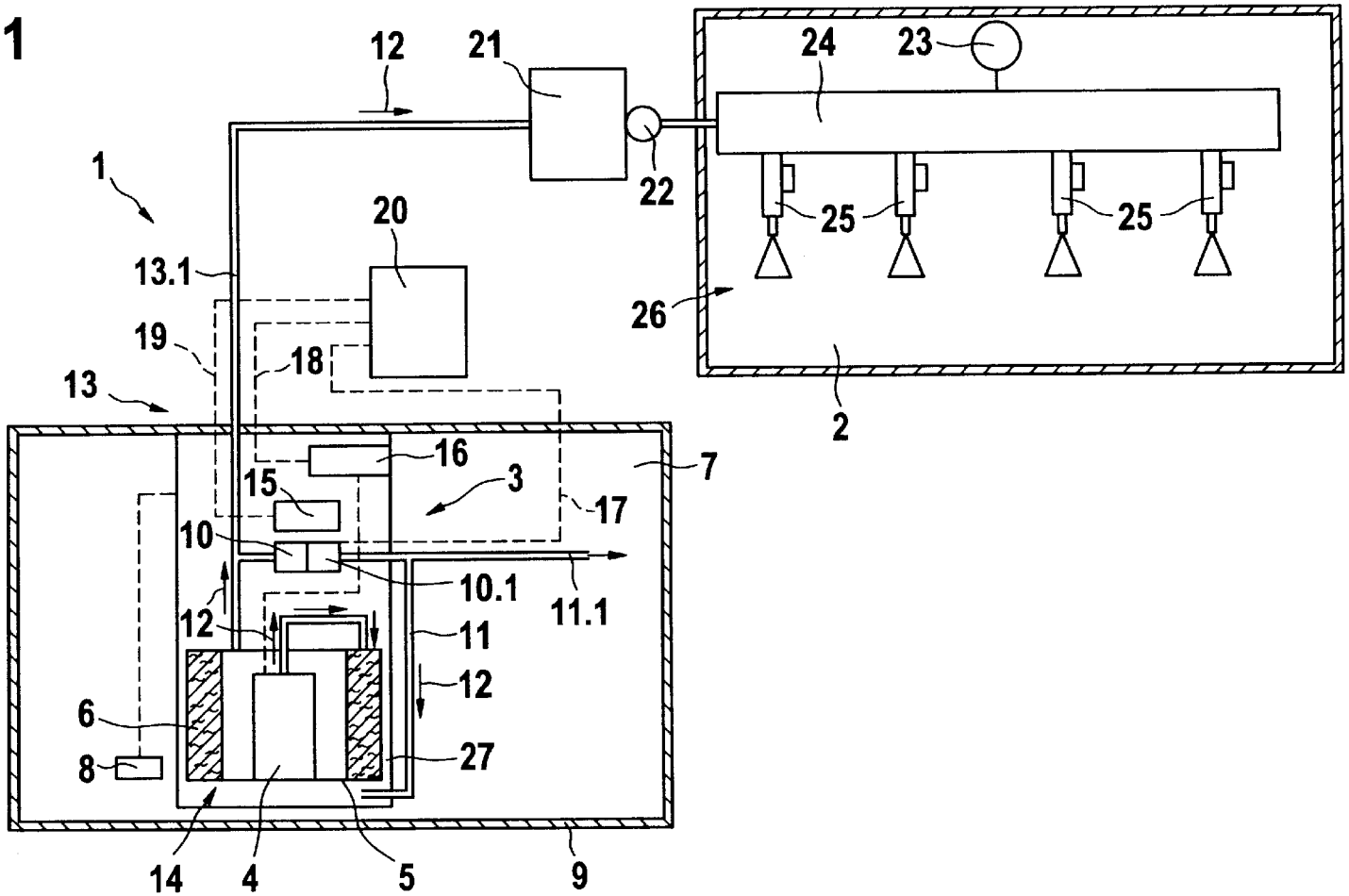
FIG. 1 is a view showing a fuel supply system for an internal combustion engine with a high pressure part and components of a fuel feeding module.

FIG. 1 shows an example a fuel supply system for an internal combustion engine with a high pressure part and components of a fuel feeding module. The invention can be used also in systems with suction pipe injection in advantageous manner.

The fuel supply system 1 supplies an internal combustion engine 2 with fuel. By means of a fuel feeding module 3 the fuel is transported from a tank 7, brought to an increased pressure level, and subsequently supplied into the high pressure part of the fuel supply system 1. The fuel feeding module 3 includes a fuel feeding aggregate 4 formed, for example, as an electric fuel pump. The fuel feeding aggregate 4 is surrounded by a cup, through which the fuel feeding aggregate 4 is supplied at a suction side with fuel from the tank 7.

A prefilter 5 is arranged before the fuel feeding aggregate 4 to filter coarse impurities from the fuel stored in the tank, before they reach the fuel feeding aggregate 4. A filter element 6 surrounds the fuel feeding aggregate 4 and filters out finest impurities from the fuel. Fuel passes through the filter element 6 before it is supplied to the further fuel system. The filling level in the supply tank 7 is detected by means of a float element 8 which is connected with the fuel feeding module 3. In addition to the configuration at the tank 7 in FIG. 1 which shows a schematic representation of the fuel feeding system 1, also another course of the tank limiting 9 can be recommended.

In the fuel feeding module 3 which receives the fuel feeding aggregate 4 and the filter element 6 in a common housing 5, a switchable adjusting member 10 is associated with a pressure conduit 13.1 through which the fuel is supplied to the high pressure part of the fuel supply system 1, in a branch of the return conduit 11 to the supply tank 7. The switchable adjusting member 10 contains a throttle element 10.1 and both components preferably are formed as an assembly. Pumps which are shown here are supplied through the return conduit 11 and fill the cup which surrounds the fuel feeding aggregate 4 with fuel.

In the fuel feeding module 3 at its pressure side 13 above the fuel feeding aggregate 4, a pressure measuring element 15 is arranged. It is connected through a signal conductor 19 with a control device. In addition to the pressure sensor 15, a cycle module 16 is provided in the fuel feeding module 3. It is connected through a control conduit 18 with the control device 20. The pressure conduit 13.1 extends from the pressure side 13 to a high pressure pump 21. It has an integrated return valve which supplies the fuel via a distributor 24 to individual high pressure injection valves 25. The injection valve inject fuel in individual combustion chambers 26 of the internal combustion engine 2, each associated with the high pressure injection valve 25. The distributor 24 is associated with a high pressure sensor 23, with which the actual fuel pressure acting in the distributor 24 can be determined.

The switchable adjusting member 10, which leads in the return conduit 11 to the pump which fills the cup of the fuel feeding aggregate 4, is connected via a control conductor 17 with the control device 20. In a first embodiment switchable adjusting member is formed as a blocking valve 10 with the associated throttle element 10.1 with a constant cross-section. The throttle cross-section of the throttle element 10.1 is selected so that at low system pressure during the operation a sufficient supply of the pumps provided in the supply tank 7 is guaranteed for filling of the cup of an electric fuel pump. Advantageously, the switchable adjusting member 10 and the throttle 10.1 are formed as an assembly, which can be integrated in accordance with a modular principle in the fuel feeding module 3 in a space-economical manner.

The switchable of adjusting member 10 which blocks the return conduit 11 is closed during the advance phase, or in other words pressure build up, of the fuel feeding aggregate 4. During this time period the return conduit 11 is blocked to the tank, that during this uncritical phase supplies the pumps located on the top of the fuel feeding aggregate 4, which is unproblematic. By blocking of the return conduit 11 during the starting process, a flow out of an overflow quantity through the return conduit 11 for supplying the pumps for the cup of the fuel feeding aggregate 4 is prevented, and thereby an improved pressure buildup by the pressure feeding aggregate 4 is obtained. The return conduit 11 returns the fuel to a jet pump 27. Optionally a branch 11.1 can be provided to further jet pumps 27, for example for circulating the fuel during the use of subdivided or inclined tanks.

The pressure buildup during starting is not delayed, since during reaching a predetermined pressure by opening of a mechanical to overflow valve a flow out of an overflow quantity is provided through the return conduit 11, as was the case with mechanical overflow valves. In particular in cold start, longer blocking remains when compared with the conventional variants of the return conduit 11, which is very favorable for reaching higher starting pressure, in particular at low battery voltage.

After the performed pressure build up, the electric adjusting member 10 is open through control conductors 17 by the control device 20 and provides through the throttle element 10.1 a measured supply, in correspondence with the throttle cross-section of the pumps for cup filling of the fuel feeding aggregate 4. In turning off case, the switching or adjusting member 10 is closed by controlling through the control device 20, for maintaining the pressure at the pressure side 13 of the fuel feeding module 3. In the post-heating phase which occurs after turning off of the internal combustion engine, the pressure can increase due to the heat expansion of fuel. By maintaining the blocking of the return conduit 11 by the switchable adjusting member 10, at the pressure side 13 of the fuel supply system 1 an increased system pressure is maintained, which counteracts a vapor bubble formation in the fuel supply system and advantageously influences the hot start conditions. In this case, the switchable adjusting member 10, controllable by the control device 20 is closed without current, the return conduit 11 which contains a tank-side return valve is blocked, the pressure in the system can not reduce in disadvantageous manner via the return conduit 11. The pressure can be increased to the pressure, to which the pressure limiting valve integrated in the electric fuel pump is adjusted.

In a second embodiment of the switching adjusting member 10 it can be formed as a cycled valve with a variable throttle cross-section. A design of a throttle element 10.1 with a constant cross-section can provide an increase of the overflow quantity with the increase of the fuel pressure. Since at high pressure the feeding quantity of the fuel feeding aggregate 4 goes backwards, it is correspondingly loaded. With a cycled valve, depending on the control of the electric fuel pump and the valve 10, the overflow quantity is adjusted through the return conduit 11 by different throttling in a desired manner. The control by the control device 20 can be performed during a normal operation, for example so that, the overflow quantity with all operational pressures is adjusted constant to the minimal consumption of the pump for cup filling of the electric fuel pump. The required ration can be determined for example from a characteristic field in dependence on fuel nominal pressure and required minimal overflow quantity. The required overflow quantity can be selected constant or also dependent on a filling level in the cup of the fuel feeding aggregate, and in subdivided tanks with several chambers it can be selected also dependent on the filling level of the tank. By means of this variant of the switchable adjusting member 10, the overflow quantity can be limited via a cycled valve, and the fuel feeding aggregate 4 can be unloaded. On the other hand a reliable covering of the motor consumption can be guaranteed at high system pressures.

Figure 2:
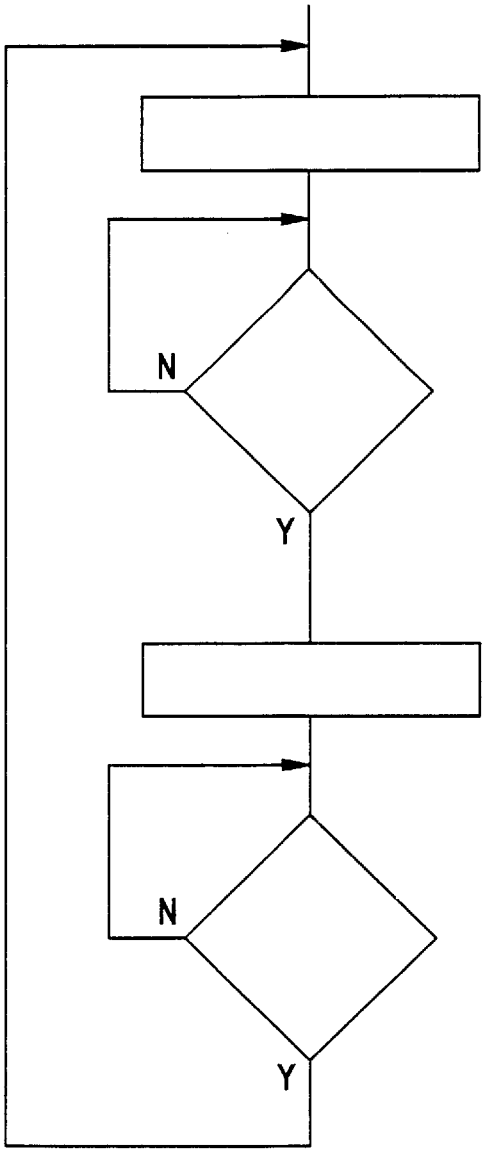
FIG. 2 is a view showing a flow chart for an inquiry of an adjusting member.
Figure 2:
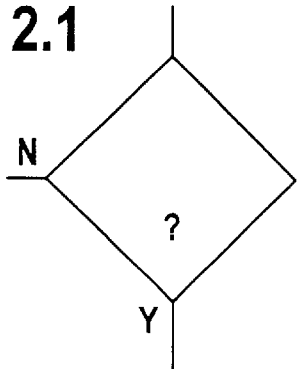
Figure 2:
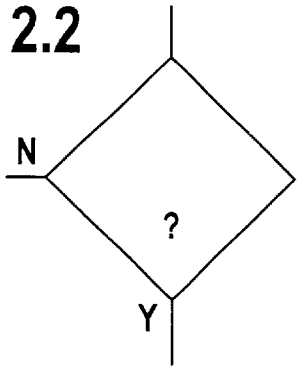
Figure 2:
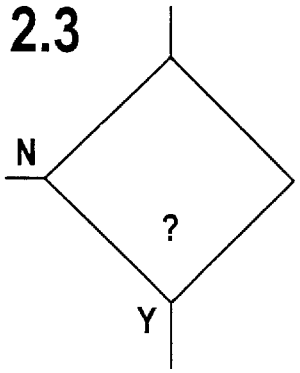
Figure 2:
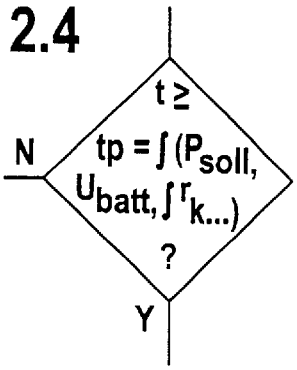

FIGS. 2, 2.1–2.4 shows an example of a flow diagram for inquiry of a switchable adjusting member.

During the starting phase the first with closed adjusting member an inquiry is performed, where the required pressure build up takes place. When it is so, the switchable adjusting member 10 can be open by the control 7 through the control device 20. The start end can be defined in FIG. 2.1 by the setting or not setting of a start bit. If the motor is started, the switchable adjusting member 10 can be open. When it is not so, it remains closed. In addition to the inquiry of a start bit, also an inquiry of the pressure can be implemented. Through the pressure sensors 15, 23, it can be inquired whether the actual pressure is greater or equal to the fuel nominal pressure. When this 5 is so, the switchable adjusting member 10 can be open. When it is not, it remains closed (FIG. 2.2). In the condition in accordance with FIGS. 2.3 and 2.4 for the opening of the switchable adjusting member 10 inclusive, the elapsing of a fixed time period or a time period dependent on fuel pressure and/or battery voltage, is detected and thereafter the switchable adjusting member 10 is open.

A combination of several conditions is shown in FIGS. 2.4 where the time period is determined as a function of a fuel nominal pressure and a battery voltage. In accordance with a flow chart in FIG. 2, in the turning off case the switchable adjusting member is again closed, in order to guarantee a pressure in the fuel supply system which is higher when compared with the conventional mechanically openable overflow valve, to substantially improve a subsequent hot start.

It will be understood that each of the elements described above, or two or more together, may also find a useful application in other types of constructions differing from the types described above.

While the invention has been illustrated and described as embodied in operation control for a fuel feeding module with variable system pressure, it is not intended to be limited to the details shown, since various modifications and structural changes may be made without departing in any way from the spirit of the present invention.

Without further analysis, the foregoing will so fully reveal the gist of the present invention that others can, by applying current knowledge, readily adapt it for various applications without omitting features that, from the standpoint of prior art, fairly constitute essential characteristics of the generic or specific aspects of this invention.

What is claimed as new and desired to be protected by letters patent is set forth in the appended claims.

What is claimed is:

1. A fuel supply system for supplying an internal combustion engine, comprising a consumption-controlled fuel feeding module which is connectable at a suction side with a supply tank and at a pressure side with an internal combustion engine; a fuel feeding aggregate; a pump; a pressure conduit provided at a pressure side of said fuel feeding aggregate and leading to said pump for filling said fuel feeding aggregate; an advance-supplied return element; a switchable adjusting member which blocks said return element; and a throttle element which adjusts a return quantity of fuel at all operational pressures above a minimal consumption.

2. A fuel system as defined in claim 1; and further comprising a control device with which said switchable adjusting member is connected.

3. A fuel system as defined in claim 1, wherein said switchable adjusting member is formed as a check valve, with which said throttle element is associated.

4. A fuel system as defined in claim 3, wherein said switchable adjusting member and said throttle element form an assembly.

5. A fuel system as defined in claim 3, wherein said throttle element is formed so that a throttle cross-section at a lowest system operational pressure allows a supply of said pump associated with said return conduit for filling said fuel feeding aggregate.

6. A fuel system as defined in claim 1; and further comprising a controllable cycled valve which controls said switchable adjusting member through said control element, said controllable cycled valve is throttled differently depending on a control.

7. A fuel system as defined in claim 6, wherein said fuel feeding member is provided with a cycled module which communicates through said control element with a control device.

8. A method of operating a fuel supply system for an internal combustion engine with a consumption-controlled fuel feeding module and a return conduit associated with said consumption-controlled fuel feeding module for filling of a fuel feeding aggregate, the method comprising the steps of blocking the return conduit during a start phase and a turning off phase to form a pressure buildup; opening of a switchable adjusting member after a start end or in a predetermined time period or after detection of said pressure buildup by output data of a control device of the internal combustion engine; and limiting a fuel quantity that flows back through the return conduit to a supply tank to a quantity required for filling of the fuel feeding aggregate and for circulating fuel in a subdivided supply tank.

9. A method as defined in claim 8, and further comprising determining a time point for opening of the return conduit by the switchable adjusting member after a detected start end.

10. A method as defined in claim 9; and further comprising defining the start end by setting a bit.

11. A method as defined in claim 8; and further comprising fixedly providing the predetermined time period.

12. A method as defined in claim 8; and further comprising selecting the time period in dependence on nominal fuel pressure.

13. A method as defined in claim 8; and further comprising selecting the time period in dependence on a battery voltage.

14. A method as defined in claim 8; and further comprising the step of selecting the time period in dependence on an integral over an injected fuel quantity.

15. A method as defined in claim 8; and further comprising performing a time point of opening of the return conduit by the switchable adjusting member depending on a pressure signal of a pressure sensor.

16. A method as defined in claim 8; and further comprising adjusting an overflow quantity for all operational pressures to a minimum consumption for filling a fuel feeding module or for circulating fuel in a subdivided or angled tank.

17. A method as defined in claim 16; and further comprising determining a required sensing ratio from a characteristic field in dependence on fuel nominal pressure and required minimal overflow quantity.

18. A method as defined in claim 17; and further comprising selecting a required overflow quantity constant, or in dependence on a filling level in a cup of the fuel feeding aggregate, and in a subdivided supply tank determining the required overflow quantity in dependence on a filling level of tank halves.

19. A method as defined in claim 18; and further comprising performing a control of the switchable adjusting member in dependence on a filling level in a cup of the fuel feeding aggregate, and in a subdivided fuel tank also in dependence on a filling level of tank halves.

* * * * *